United States Patent [19]

Iten

[11] 4,095,691

[45] Jun. 20, 1978

[54] PACKAGE FOR RELEASABLE CONTAINMENT OF RAZOR BLADES AND THE LIKE

[75] Inventor: Clemens A. Iten, Staunton, Va.

[73] Assignee: American Safety Razor Company, Staunton, Va.

[21] Appl. No.: 694,783

[22] Filed: Jun. 10, 1976

[51] Int. Cl.[2] ..... B65D 85/54

[52] U.S. Cl. ..... 206/354; 206/634; 229/87 J

[58] Field of Search ..... 206/353–360, 206/484, 498; 229/87 J, 51 TS, 51 R

[56] References Cited

U.S. PATENT DOCUMENTS

| | | | |
|---|---|---|---|
| 1,986,230 | 1/1935 | Talbot | 206/354 |
| 2,235,699 | 3/1941 | Dickson | 206/354 |
| 2,598,324 | 5/1952 | Wathon | 206/354 |
| 2,849,109 | 8/1958 | Rommel | 206/498 |
| 2,928,531 | 3/1960 | Henley | 206/357 |
| 3,370,365 | 2/1968 | Vosbikian | 206/484 |
| 3,414,414 | 12/1968 | Christine et al. | 206/498 |
| 3,563,405 | 2/1971 | Zaremski | 206/498 |
| 3,856,144 | 12/1974 | Kelly | 206/498 |
| 3,972,417 | 8/1976 | Iten | 206/354 |

FOREIGN PATENT DOCUMENTS

| | | | |
|---|---|---|---|
| 788,314 | 6/1968 | Canada | 206/484 |
| 895,507 | 11/1953 | Germany | 206/355 |
| 2,364,648 | 6/1975 | Germany | 206/353 |
| 167,271 | 6/1921 | United Kingdom | 206/353 |
| 369,147 | 3/1932 | United Kingdom | 229/87 J |

*Primary Examiner*—Herbert F. Ross
*Attorney, Agent, or Firm*—Morris Liss; Israel Gopstein

[57] ABSTRACT

A package for releasable containment of flat articles having apertures therethrough includes a card having plural tear-away portions each in facing relation to a contained article and an overlay in facing relation to the card and articles with an adhesive securing the overlay to the card at first locations exteriorly of the articles and at second locations in registry with apertures in the articles.

12 Claims, 12 Drawing Figures

PACKAGE FOR RELEASABLE CONTAINMENT OF RAZOR BLADES AND THE LIKE

FIELD OF THE INVENTION

This invention relates to packages for releasable containment of generally flat articles and more particularly to flat packages for individual dispensing of contained razor blades.

BACKGROUND OF THE INVENTION

A vast variety of flat cardboard packages is known for containing plural razor blades and facilitating individual dispensing. While the art has looked in various directions, for example, non-adhesive mechanical interlock dispensing packages as shown in Muros U.S. Pat. Nos. 2,425,337 and 2,670,841 and Monnet U.S. Pat. No. 2,229,114, it would appear that its major effort has been directed to the simpler blade retaining and release provided in packages employing adhesives. Of this latter type of package, the following listed patents are noted to employ full adhesive coatings or varied arrangements of dispersed spots of adhesive material to retain blades in a generally flat package: Gambrill, Jr. U.S. Pat. No. 2,298,362, Rommel U.S. Pat. No. 2,849,109, Gray U.S. Pat. No. 2,644,576, Auerbach U.S. Pat. No. 2,675,909, Muros U.S. Pat. Nos. 2,280,442 and 2,014,977, Zeller U.S. Pat. No. 1,489,379, Shnitzler U.S. Pat. No. 2,677,458 and Heppenstall, Jr. U.S. Pat. No. 1,989,516. Adhesive selection, as seen in the foregoing patents, has run the gamut from wet adhesives to dry adhesives, with heat-sealable adhesives being discussed, for example, in Zeller U.S. Pat. No. 1,734,551.

The packages of the foregoing patents of the adhesive type are considered to exhibit various characteristics which render them less than desirable from a commercial point of view. Thus, for example, numerous of these disclosed structures are cumbersome to manufacture and provide limited viewability of the blades. All have in common the undesired application of adhesive in activated form directly to the surfaces of the blade.

SUMMARY OF THE INVENTION

It is an object of the present invention to provide a simplified package of adhesive type for releasable containment of razor blades or like generally flat articles.

It is a more particular object of the invention to provide such simplified package with enhanced viewability of its contents and elimination of application of adhesive directly to article surfaces.

It is a still further object of this invention to provide methods and apparatus for use in making such simplified packages.

In attaining the foregoing and other objects, the invention provides a package for releaseable containment of flat apertured articles wherein a card includes separable portions, each facing an article, and an overlay is secured to the card by an adhesive extending through article apertures between surfaces of the card and overlay in registry with the aperture. In its particularly preferred embodiment, the package card has a generally central expanse in each of its tear-away portions in registry with the article aperture and having a perimeter partially cut through the card. In removing an article from the package, the tear-away portion is removed, leaving the article joined to the overlay by a remnant of the tear-away portion, namely, its partially cut expanse. The article is then removed from the overly by simple deformation of such remnant of the tear-away portion. The card desirably includes a coating of thermoplastic material whereby the securement of the overlay to the card may be accommodated by heat sealing apparatus. The invention further provides methods for making such package.

The foregoing and other objects and features of the invention will be further evident from the following detailed description of preferred embodiments thereof and from the drawings wherein like reference numerals identify like parts throughout.

DESCRIPTION OF THE DRAWINGS

FIG. 2 is a sectional view as seen from plane II—II of FIG. 1.

DESCRIPTION OF THE PREFERRED EMBODIMENTS

Figure 1:
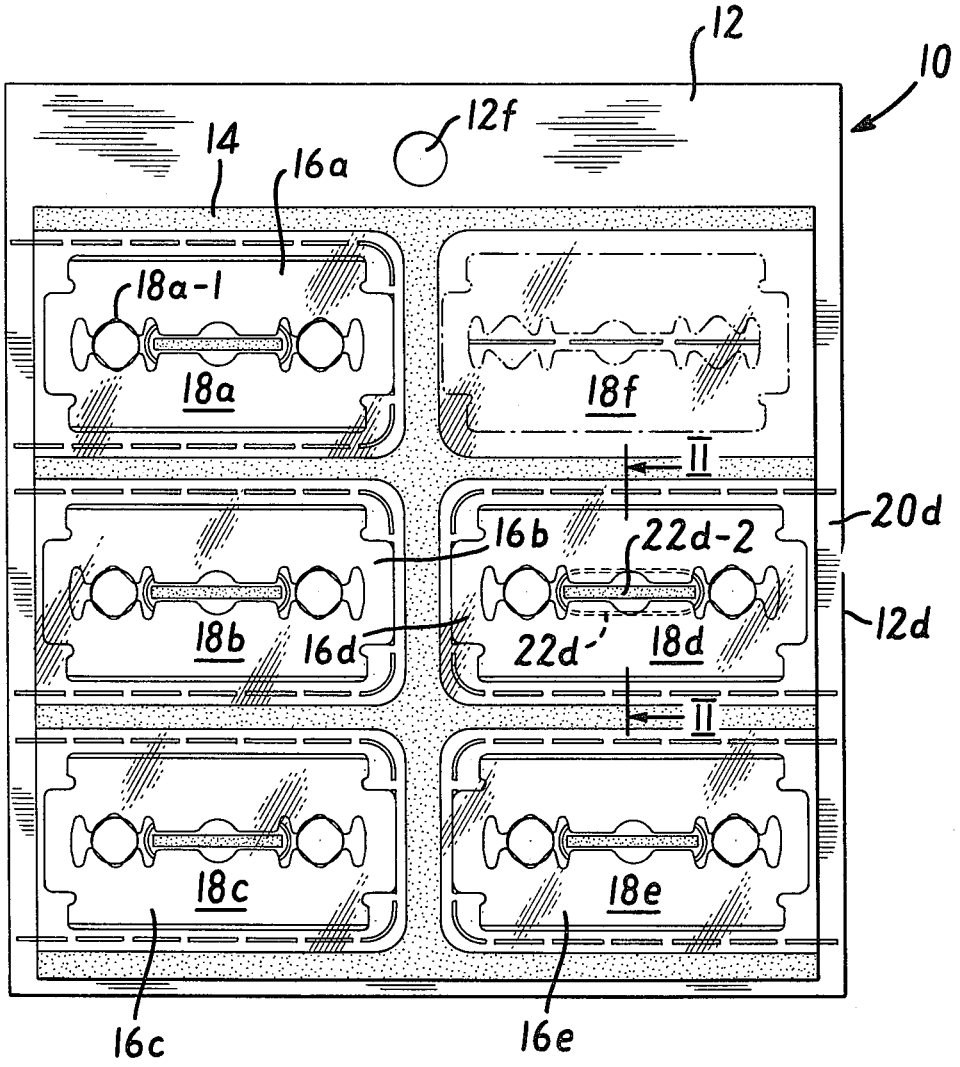
FIG. 1 is a front elevational view of a package in accordance with the invention containing double edge blades.

Referring to FIG. 1, package 10 includes support card 12 and overlay 14, blades 16*a*–16*e* being disposed in compartments 18*a*–18*e* formed in the package between card 12 and overlay 14. Compartment 18*f* is shown as containing a blade in phantom outline. This compartment may be employed for used blade storage, as discussed below. Overlay 14 is desirably comprised of transparent plastic material and the facing surface of card 12 is desirably colored to provide enhanced viewability for display purposes.

As shown in FIG. 2 and indicated in FIG. 1 by the stipling, overlay 14 is secured to card 12 over selected areas thereof, inclusive of areas of the overlay and card in facing relation through the apertures of the contained blades.

Figure 3:
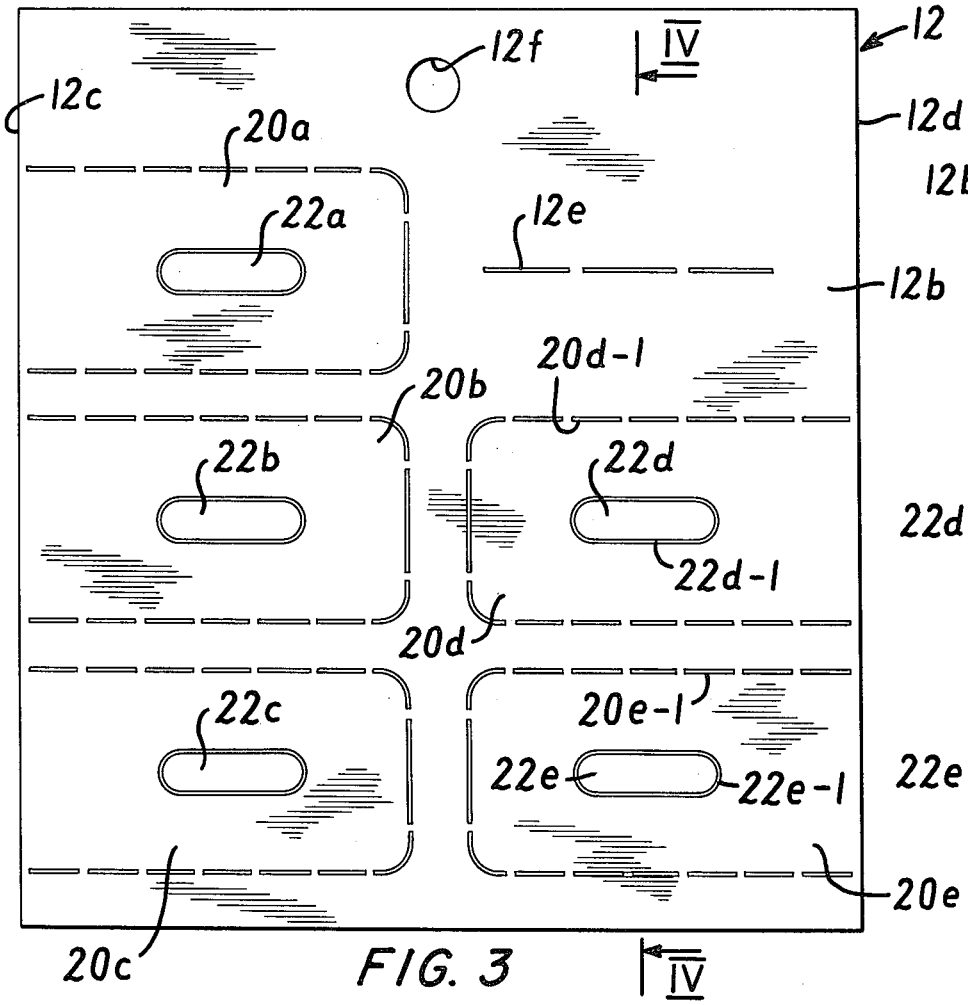
FIG. 3 is a front elevational view of the card of the FIG. 1 package.
Figure 4:
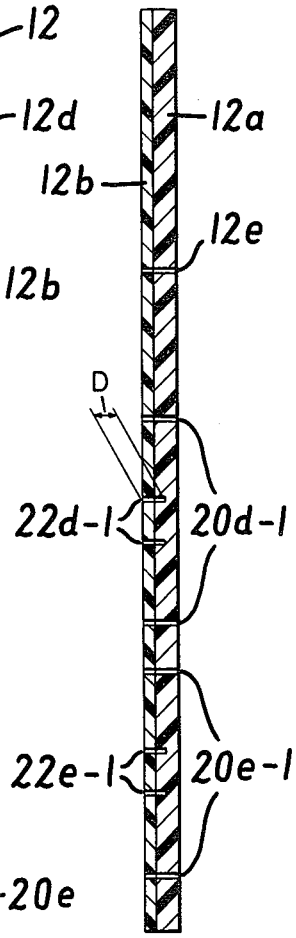
FIG. 4 is an enlarged sectional view as seen from plane IV—IV of FIG. 3.

Card 12 is shown separately from the FIG. 1 assembly in FIGS. 3 and 4, the latter indicating the card to be comprised of a support layer 12*a*, preferably formed of paperboard, and coating 12*b*, preferably of thermoplastic material. The card includes tear-away portions 20*a*–20*e*, the perimeter of each such tear-away portion being inclusive of one of edges 12*c* and 12*d* of the card. The remaining perimeter of the portions is provided by spaced slits or scored lines extending between layers 12*a* and 12*b* and through the opposed surfaces of card 12 as shown at 20*d*-1 and 20*e*-1 for portions 20*d* and 20*e*, respectively, in FIG. 4. Each tear-away portion has a generally central expanse, 22*a*–22*e*. The perimeters of such expanses are only partially cut through the card, being provided by slits extending through an exclusive one of the opposed surfaces of the card for approximately half the thickness of the card, as shown at 22d-1 and 22e-1 for expanses 22d and 22e, respectively, in FIG. 4. Score line 12e is in position to register with compartment 18f on assembly whereby compartment 18f may be expanded to accommodate storage of multiple used blades. The card may include a hole 12f for display hanging.

Overlay 14 (FIG. 5) includes, in the embodiment under discussion, apertures 24a–32a and 24b–32b. These apertures are so arranged that pairs thereof are in registration with the apertures of individual blades in assembly of the package. Thus, the aperture pair 24a, 24b is in registry with apertures of the blade to be contained in compartment 18a. In a further embodiment discussed below, such overlay apertures are dispensed with.

In FIGS. 1 and 2, blade 16d is shown contained within compartment 18d by joinder of the central part 22d-2 of expanse 22d to overlay 14. With overlay 14 of outer dimensions less than those of card 12 (FIG. 1), its perimeter is interior to the perimeter or card 12 and tear-away portion 20d extends beyond overlay 14 to card edge 12d and may be readily grasped by a user. So grasped, portion 20d is torn away from card 12 by displacing it inwardly in FIG. 1. In the course of such tearing away of portion 20d, expanse 22d thereof remains secured to overlay 14 through part 22d-2 to the cut depth D indicated in FIG. 4. Accordingly, blade 16d remains secured to overlay 14 on removal of tear-away portion 20d. Blade 16d is next removed from overlay 14, expanse 22d being deformed into generally V-shaped configuration by the blade and thereby releasing the blade by travel of the blade aperture inwardly in FIG. 1 over the deformed remnant of expanse 22d.

Figure 7:
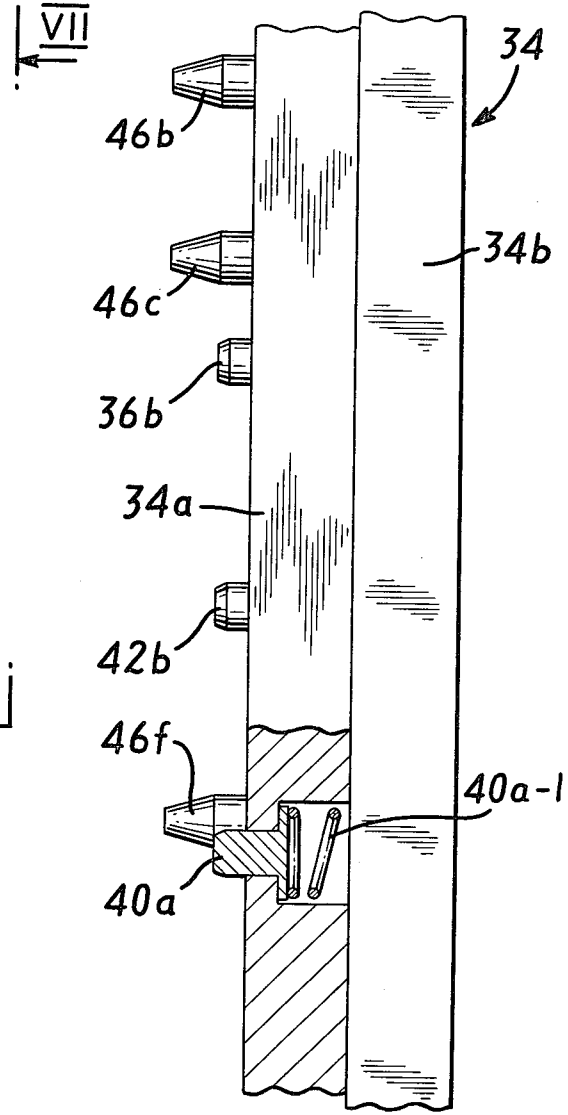
FIG. 7 is a side view, partly in section, as seen from the broken plane VII—VII of FIG. 6.

Turning now to methods and apparatus for making the package discussed to this juncture, assembler 34 (FIGS. 6 and 7) includes foreplate 34a and back plate 34b which are separable to permit insertion of overlay and blade locator pins 36a–44a and 36b–44b through apertures provided in foreplate 34a. Springs, one being shown as 40a-1, are then seated in the foreplate rearwardly of the pins to abut against back plate 34b. Card locator posts 46a–46g are fixedly supported on foreplate 34.

Figure 8:
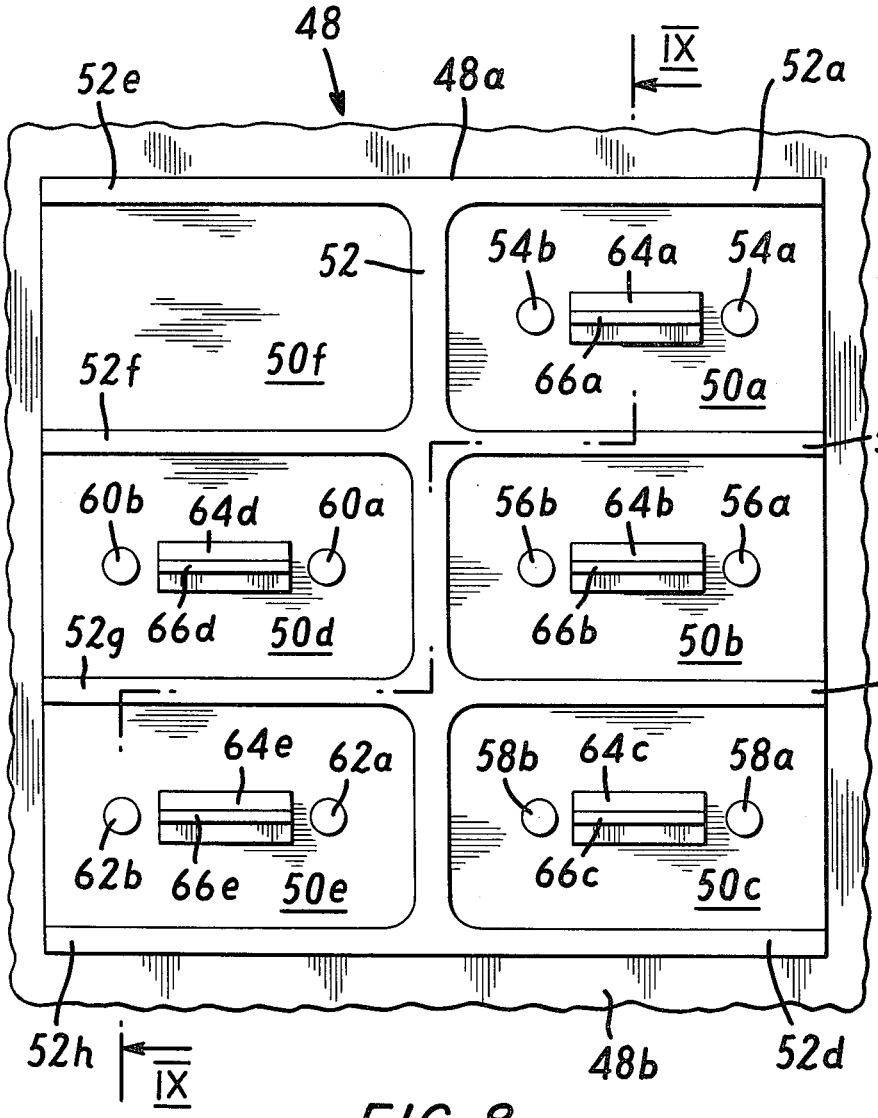
Figure 9:
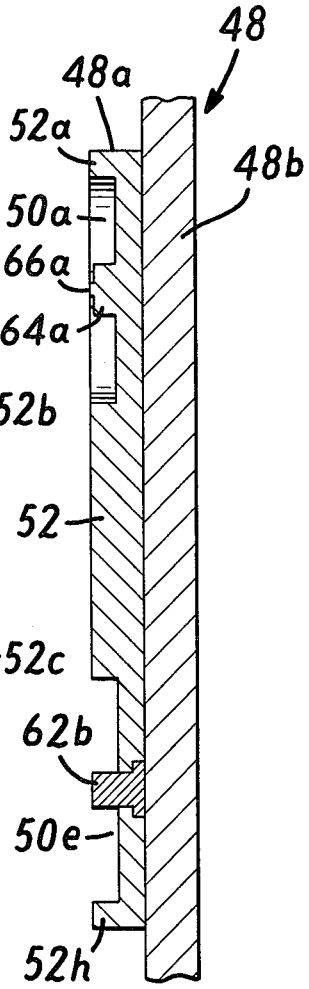
FIG. 9 is a sectional view as seen from the broken plane IX—IX of FIG. 8.

As shown in FIGS. 8 and 9, assembler 48 includes foreplate 48a and back plate 48b. Foreplate 48a has recessed areas 50a–50f, with a continuous frontal surface defined by central rib 52 and branches 52a–52h. In the recessed areas, the foreplate has pins 54a–62a and 54b–62b and projections 64a–64e having elevated rib members 66a–66e.

Figure 6:
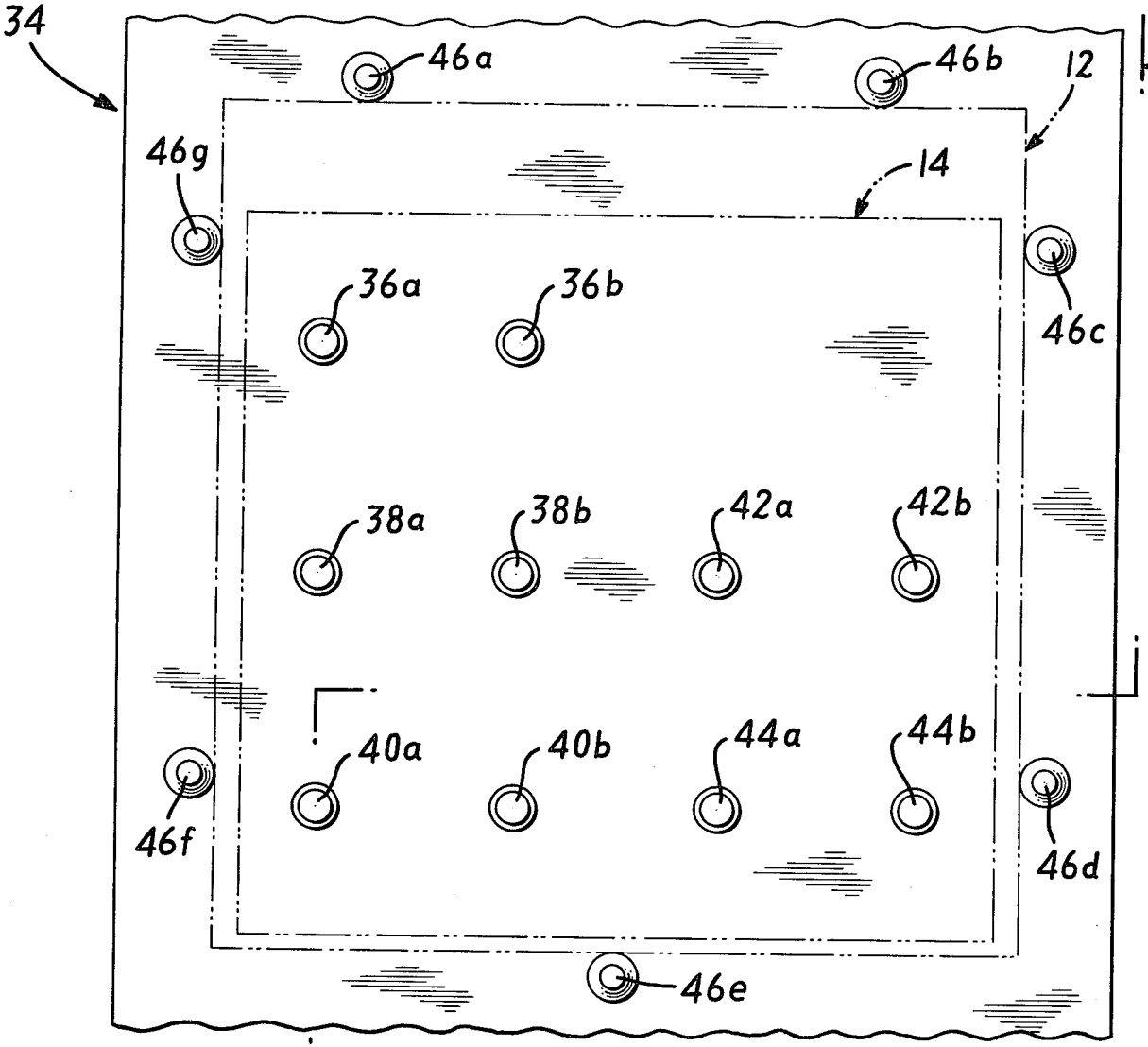
FIGS. 6 and 8 depict mating halves of apparatus for making the FIG. 1 package.

In use of assemblers 34 and 48 to manufacture the package of FIG. 1, overlay 14 is placed on foreplate 34a, as shown in phantom in FIG. 6, with the overlay apertures encircling the blade and overlay locator pins of assembler 34, i.e., overlay aperture 24a encircling locator pin 36a, etc. Next, blades 18a–18e (FIG. 1) are arranged atop overlay 14 with the blade sideward apertures in registry with such locator pins of assembler 34, i.e., blade aperture 18a-1 (FIG. 1) in registry with locator pin 36a, etc. Card 12 is now arranged as shown in phantom in FIG. 6 interiorly of card locator posts 46a–46g with its coating 12b resting atop the blade and overlay locator pins of assembler 34. Assembler 48, with foreplate 48a suitably heated, is now pressed, interiorly of card locator posts 46a–46g of assembler 34, upon layer 12a of card 12, such that its fixed pins 54a–62b are aligned with spring-biased pins 36a–44b of assembler 34. The latter pins are accordingly driven interiorly of foreplate 34a, with the card, blades and overlay being forced between assemblers 34 and 48 into the sandwich relation depicted in FIG. 2, i.e., with the center of expanse 22d (FIG. 3) being pressed by rib 66d (FIG. 8) through the central aperture of blade 16d to form the heat-sealed joinder area at first location 22d-2 of card 12 in FIG. 1. Like first location joinder areas are formed within the central apertures of blades 16a, 16b, 16c and 16e by ribs 66a, 66b, 66c and 66e. Rib 52 and branches 52a–52h provide heat-sealed joinder areas at second locations of card 12 exteriorly of the tear-away portions thereof as shown also in FIG. 1.

While the foregoing practice has been discussed in connection with layer 12b of heat-sealable material and with the heat-sealing assemblers of FIGS. 6–9, the selective area joinder method may be practiced with other "activatable" adhesives, i.e., materials whose adhesive capacity is dormant until such as a coating thereof is subjected to conditions rendering the material adhesive.

Figure 5:
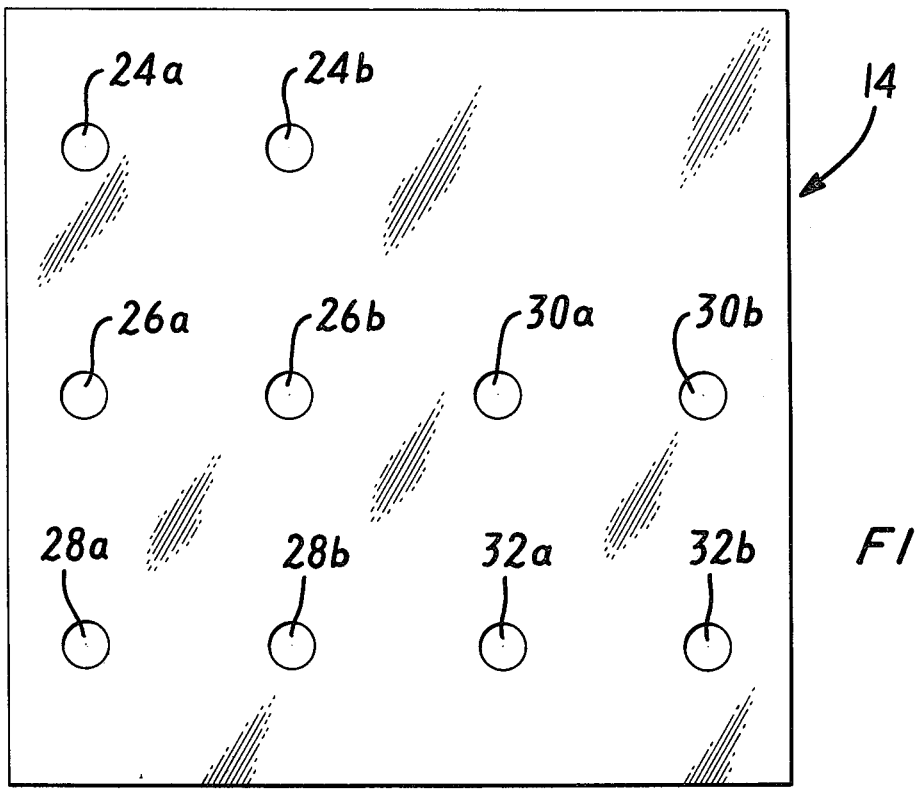
FIG. 5 is a front elevational view of the overlying member of the FIG. 1 package.
Figure 12:
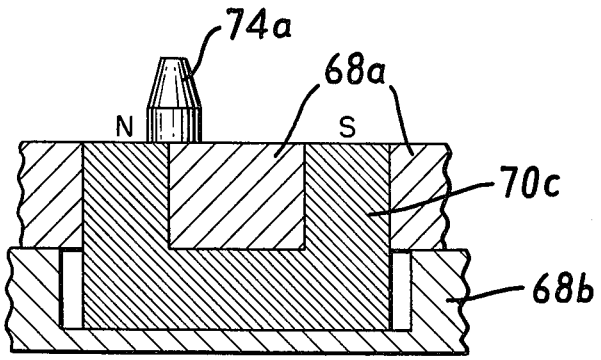
FIG. 12 is a partial sectional view as seen from plane XII—XII of FIG. 10.
Figure 11:
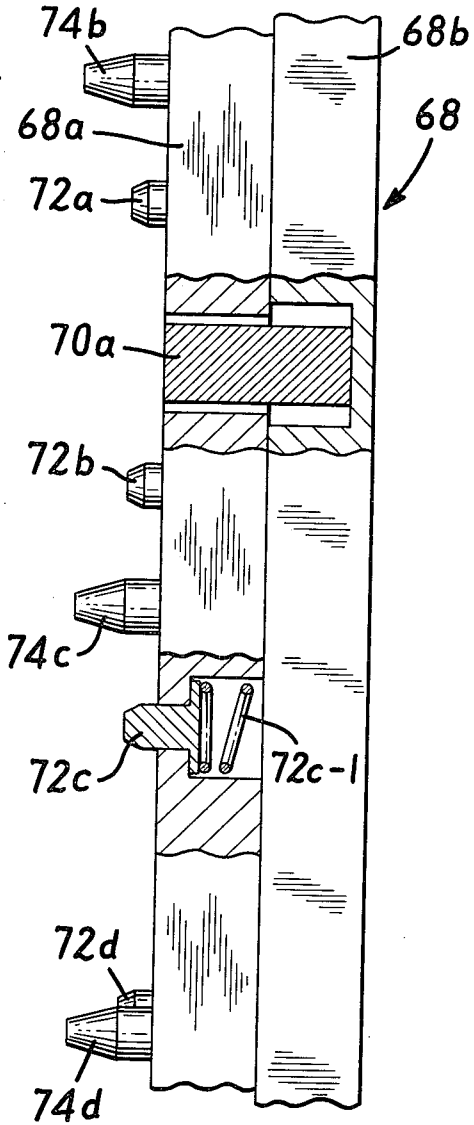
FIG. 11 is a side view, partly in section, as seen from the broken plane XI—XI of FIG. 10.
Figure 10:
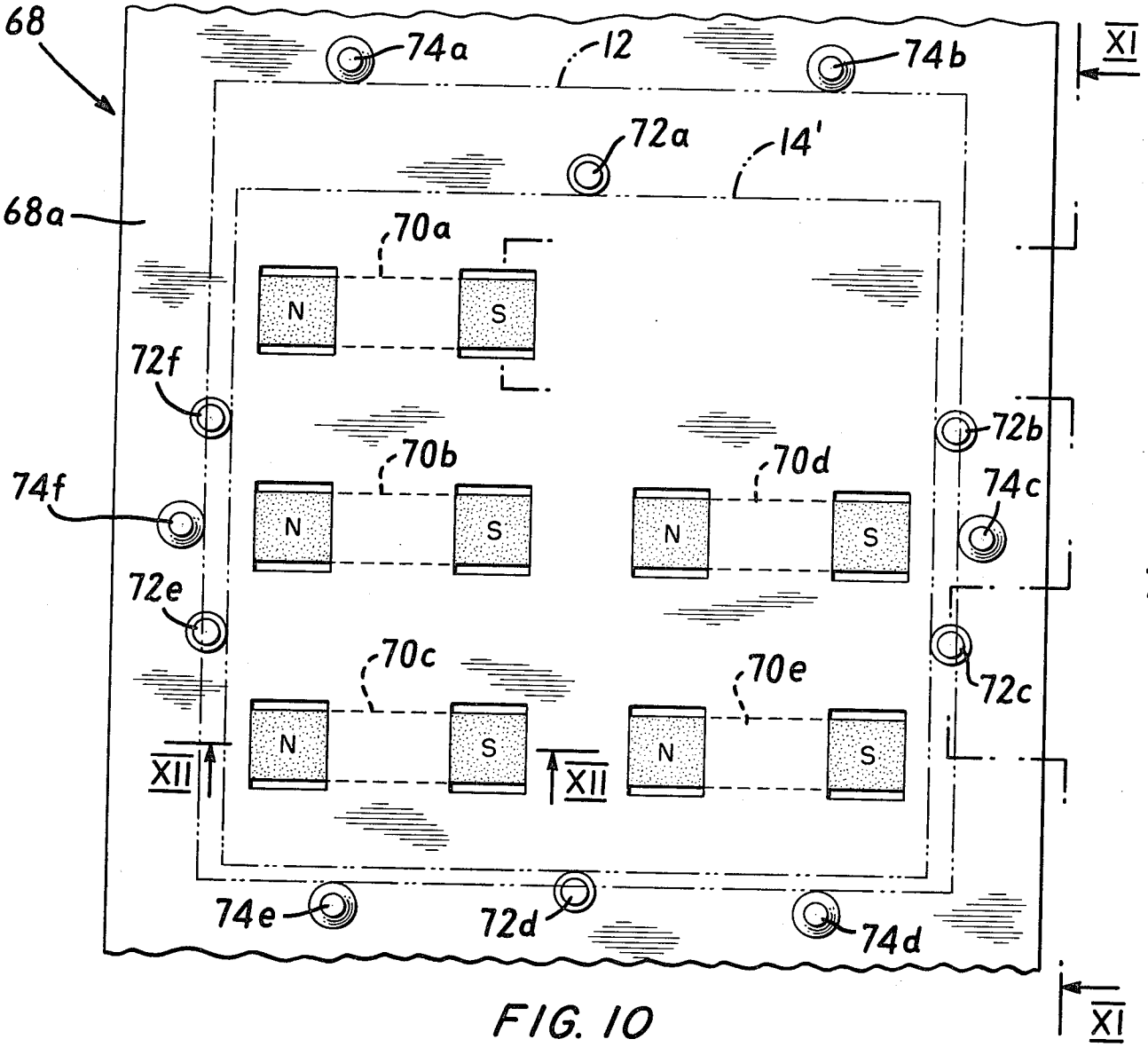
FIG. 10 illustrates a modified version of the apparatus shown in FIG. 6.

FIGS. 10, 11 and 12 depict an alternative assembler 68 for use in manufacturing a package such as shown in FIG. 1 but having an unapertured overlay, i.e., wherein apertures 24a–32b of the FIG. 5 overlay are eliminated. As will now be discussed, assembler 68 eliminates the overlay and card registration pins 36a–44b of assembler 34. A modified version (not shown) of assembler 48 is used in this practice, wherein fixed pins 54a–62b (FIG. 8) are eliminated.

Assembler 68 is comprised of foreplate 68a and back plate 68b. Permanent magnets 70a–70e are disposed in recesses in plates 68a and 68b such that opposite polarity pole faces (N and S) thereof are flush with the front surface of foreplate 68 in positions akin to the eliminated assembler pins 36a–44b. Overlay locator posts 72a–72f are spring-biased, as shown by spring 72c-1 in FIG. 11 for post 72c. Card locator posts 74a–74f are fixedly supported on foreplate 68a.

In assembly of the modified package, the unapertured overlay 14' is disposed interiorly of posts 72a–72f on foreplate 68a as shown in phantom outline in FIG. 10. Blades are next placed atop the overlay each in registration with the pole faces of an individual magnet. Card 12 is now disposed atop overlay locator posts 72a–72f interiorly of card locator posts 74a–74f. The mating assembler, i.e., the assembler of FIGS. 8 and 9 without pins 54a–62b, is now pressed onto the card, depressing posts 72a–72f into foreplate 68a and the card, blades and overlay are forced into the relationship shown in FIG. 2.

As will be appreciated, packages for containment of but an individual article may be made in accordance with the invention. As noted, packages of the invention desirably include a transparent overlay for enhanced viewability of the package contents. Suitably, polyvinyl chloride film may be employed both as the transparent overlay and as the thermoplastic, heat-sealable coating of the card. The card itself may be constituted by solid bleached sulfate paperboard. Where desired, both the overlay and the card may be comprised of such non-transparent paperboard material with the paperboard overlay either apertured or not.

Various changes and modifications may be introduced in the foregoing package, method and apparatus without departing from the present invention. For example, either or both of the overlay and card may include the activatable adhesive coating and either may be employed as the underlayer in the course of assembly by simple modification of the disclosed apparatus. Accordingly, it is to be appreciated that the particularly disclosed embodiments are intended in an illustrative and not in a limiting sense. The true spirit and scope of the invention is set forth in the following claims.

What is claimed is:

1. A package for releasable containment of a flat apertured article comprising a card having a portion separable therefrom, said article being disposed on said card portion, and an overlay disposed on said article and secured exclusively to said card at a first card location exteriorly of said card portion and at a second card location in registry with said article aperture, said card having opposed surfaces, said card portion including an expanse of area exceeding the area of said second card location and in registry therewith, said expanse having a perimeter defined by a slit so cut as to extend only through one of said card opposed surfaces, whereby said expanse remains secured to said overlay at said second card location in retaining relation to said article after separation of said card portion from said card.

2. The package claimed in claim 1 wherein at least one of said card and said overlay includes a coating of heat-sealable material, said material providing such securement of said card and said overlay.

3. The package claimed in claim 1 wherein said card portion expanse is comprised of material deformable for removal of said article from said package following such separation of said card portion from said card.

4. The package claimed in claim 3 wherein the perimeter of said card portion is defined by spaced slits extending between and through said opposed card surfaces.

5. The package claimed in claim 3 wherein at least one of said card and said overlay includes a coating of heat-sealable material, said material providing such securement of said card and said overlay.

6. The package claimed in claim 3 wherein said card portion is bounded in part by an edge of said card and wherein the perimeter of said overlay is interior to the perimeter of said card.

7. A package for releasable containment of flat apertured articles comprising a card having a plurality of portions separable therefrom, each such card portion being in facing relation to a distinct one of said articles, and an overlay in facing relation to said card and said articles and secured exclusively to said card at first card locations exterior to said card portions and at second card locations in registry with such apertures in said articles, said card having opposed surfaces, each of said card portions including an expanse exceeding the area of such article aperture and in registry therewith, each said expanse having a perimeter defined by a slit so cut as to extend only through one of said card opposed surfaces, whereby each of such expanses remains secured to said overlay at such second card location in retaining relation to said article after separation of each said card portion from said card.

8. The package claimed in claim 7 wherein at least one of said card and said overlay includes a coating of heat-sealable material, said material providing such securement of said card and said overlay.

9. The package claimed in claim 7 wherein each said card portion expanse is comprised of material deformable for removal of said article from said package following such separation of said card portion from said card.

10. The package claimed in claim 7 further including a compartment formed between said overlay and said card for return of released articles to said package following use thereof. 1

11. A package for releasable containment of a flat apertured article comprising a card having a portion separable therefrom, said article being disposed on said card portion, and an overlay disposed on said article and secured exclusively to said card at a first card location exteriorly of said card portion and at a second card location in registry with said article aperture, said card portion including an expanse integral with said card portion and of area exceeding the area of said second location and in registry therewith, said expanse being separable from said card portion in the course of separation of said card portion from said card, said expanse thereby remaining secured to said overlay for releasable retention of said article therewith.

12. The package claimed in claim 11 wherein said card portion expanse is comprised of material deformable for removal of said article from said package following such separation of said card portion from said card.

* * * * *